US005088413A

United States Patent [19]

Huber et al.

[11] Patent Number: 5,088,413

[45] Date of Patent: Feb. 18, 1992

[54] METHOD AND APPARATUS FOR SAFE TRANSPORT HANDLING ARMING AND FIRING OF PERFORATING GUNS USING A BUBBLE ACTIVATED DETONATOR

[75] Inventors: Klaus B. Huber, Sugar Land; Nolan C. Lerche, Stafford; Arnold G. Edwards, Hockley; Kenneth E. Rozek, Houston; Edward G. Smith, Jr., San Leon, all of Tex.

[73] Assignee: Schlumberger Technology Corporation, Houston, Tex.

[21] Appl. No.: 587,298

[22] Filed: Sep. 24, 1990

[51] Int. Cl.[5] ..... F42B 3/12; F42D 5/00

[52] U.S. Cl. ..... 102/202.5; 102/200; 102/202.1

[58] Field of Search ..... 89/1.15; 102/200, 202.1, 102/202.5, 202.7, 204, 206, 217, 314, 317, 320

[56] References Cited

U.S. PATENT DOCUMENTS

| | | | |
|---|---|---|---|
| 3,212,732 | 10/1965 | Scerbo et al. | 244/46 |
| 3,262,388 | 7/1966 | McCarty | 102/206 |
| 3,640,224 | 2/1972 | Petrick et al. | 102/220 |
| 3,640,225 | 2/1972 | Carlson et al. | 102/237 |
| 3,860,865 | 1/1975 | Stroud et al. | 102/217 |
| 3,895,858 | 7/1975 | Sawano | 350/255 |
| 3,978,791 | 9/1976 | Lemley et al. | 102/202.5 |
| 4,099,467 | 2/1978 | MacKellar et al. | 102/217 |
| 4,105,282 | 8/1978 | Schael | 350/10 |
| 4,108,221 | 8/1978 | Freimuth et al. | 141/146 |
| 4,307,663 | 12/1981 | Stonestrom | 102/202.4 |
| 4,421,030 | 12/1983 | DeKoker | 102/204 |
| 4,422,381 | 12/1983 | Barrett | 102/202.2 |
| 4,441,427 | 4/1984 | Barrett | 102/202.1 |
| 4,471,697 | 9/1984 | McCormick et al. | 102/202.5 |
| 4,592,280 | 6/1986 | Shores | 102/202.2 |

(List continued on next page.)

FOREIGN PATENT DOCUMENTS

| | | |
|---|---|---|
| 0029671 | 11/1980 | European Pat. Off. . |
| 1529571 | 5/1968 | France . |
| 2037269 | 11/1979 | United Kingdom . |
| 2126343 | 8/1983 | United Kingdom . |
| 2118282A | 10/1983 | United Kingdom . |

OTHER PUBLICATIONS

"Explosive Sink Rates" by Robert S. White and Andrew W. H. Bunch, Geophys. J. R. Astr. Soc. (1979), 56, 473–476.

Printout of Abstract entitled "Methods for Generating and Shaping a Seismic Source System".

(List continued on next page.)

*Primary Examiner*—Charles T. Jordan

*Attorney, Agent, or Firm*—Henry N. Garrana; John H. Bouchard

[57] ABSTRACT

An exploding foil bubble activated detonator, adapted for use in a perforating gun, includes an exploding foil, the exploding foil including as neck section which vaporizes when a current of sufficient magnitude and duration flows therethrough, a layer of polyimide material deposited over said foil, and a spacer layer deposited over said layer of polyimide material, the spacer layer including a guiding hole disposed directly over the neck section of the foil. When the current flows through the neck section of the foil, a turbulence is caused to occur directly above the neck section. This turbulence causes a portion of the polyimide material to expand to form a bubble. The bubble is shaped and sized by the guiding hole in the spacer layer which is disposed directly over the neck section of the foil. The shaped and sized bubble in the polyimide material impacts an explosive thereby detonating the explosive. A selective gun firing system may include the bubble activated detonator and functions to allow an operator to selectively fire, in a predetermined sequence, a plurality of perforators in the perforating gun, such as from bottom gun to top gun. A hall effect sensor disposed in a well truck is connected to a wireline to which the perforating gun is connected and senses a current in the wireline. A novel safety barrier is inserted into a hole in a barrel of a prior art exploding foil initiator (EFI) detonator for blocking a flying plate flying in the hole and thereby preventing accidental detonations of the EFI detonator.

22 Claims, 6 Drawing Sheets

U.S. PATENT DOCUMENTS

| | | | |
|---|---|---|---|
| 4,602,565 | 7/1986 | MacDonald et al. | 102/202.7 |
| 4,610,203 | 9/1986 | Bock | 102/217 |
| 4,632,034 | 12/1986 | Colle, Jr. | 102/312 |
| 4,662,281 | 5/1987 | Wilhelm et al. | 102/494 |
| 4,735,145 | 4/1988 | Johnson et al. | 102/202.5 |
| 4,760,791 | 8/1988 | Bock | 102/217 |
| 4,762,067 | 8/1988 | Barker et al. | 102/202.7 |
| 4,788,913 | 12/1988 | Stroud et al. | 102/202.5 |

OTHER PUBLICATIONS

"Explosives Return to Marine Seismic Surveying" by Carl H. Savit, Western Geophysical Co. (1970).

"The Aquaseis Seismic Source System" by F. Murray, Abstracts of Papers, Salzburg Meeting.

Meeting notes dated 29 Mar. 89 (Bob Myers, Walley Vorek, Klaus Huber, Glen Edward and Ken Rozek).

"Diode Switched Gun Firing System" diagram.

"Performance Criteria for Small Slapper Detonators", Controller, Her Majesty's Stationery Office, London 1984.

"New Developments in the Field of Firing Techniques" by K. Ziegler, Propellants, Explosives, Pyrotechnics 12, 115-120 (1987).

"A Low-Energy Flying Plate Detonator", by A. K. Jacobson, Sandia National Laboratories Report, SAND 81-0487C, Albuquerque, N.M., 1981, pp. 49-1 through 49-20.

"Application of Slapper Detonator Technology to the Design of Special Detonation Systems", by W. H. Meyers, Proc. 12th Symposium on Explosives and Pyrotechnics, San Diego, Calif., Mar. 13-15, 1984, Detonation Systems Development, Los Alamos National Laboratory, pp. 4-5 through 4-19.

"CP DDT Detonators: II. Output Characterization", by M. L. Lieberman, Sandia National Laboratories Report SAND 83-1893, Albuquerque, N.M., pp. 3-105 through 3-112.

"A Fast, Low Resistance Switch for Small Slapper Detonators", by D. D. Richardson and D. A. Jones, Department of Defense Materials Research Laboratories Report MRL-R-1030, Victoria, Australia.

"The Effect of Switch Resistance on the Ringdown of a Slapper Detonator Fireset", by D. D. Richardson, Department of Defense Materials Research Laboratories Report MRL-R-1004, Victoria, Australia.

"Flyer Plate Motion and Its Deformation During Flight", by H. S. Yadav and N. K. Gupta, Int. J. Impact Engng., vol. 7, No. 1, 1988, pp. 71-83.

"Mossbauer Study of Shock-Induced Effects in the Ordered Alloy $Fe_{50}Ni_{50}$ In Meteorites", by R. B. Scorzelli, I. S. Azevedo, J. Danon and Marc A. Meyers, J. Phys. F: Met. Phys. 17 (1987), pp. 1993-1997.

"Effect of Shock-Stress Duration on the Residual Structure and Hardness of Nickel, Chromel, and Inconel", by L. E. Murr and Jong-Yuh Huang, Materials Science and Engineering, 19 (1975), pp. 115-122.

"Critical Energy Criterion for the Shock Initiation of Explosives by Projectile Impact", by H. R. James, Propellants, Explosives, Pyrotechnics 13, (1988), pp. 35-41.

"High-Temperature-Stable Detonators", by R. H. Dinegar, Proc. 12th Symposium on Explosives and Pyrotechnics, San Diego, Calif., Mar. 13-15, 1984, Los Alamos National Laboratory, pp. 4-1 through 4-4.

"Shock Initiation of PETN", by J. C. Cheng, Monsanto Research Corporation, Miamisburg, Ohio, pp. 1-31 through 1-35.

"Exploding Metallic Foils for Slapper, Fuse, and Hot Plasma Applications: Computational Predictions, Experimental Observations", by I. R. Lindemuth, J. H. Brownell, A. E. Greene, G. H. Nickel, I. A. Oliphant and D. L. Weiss, Thermonuclear Applications Group, Applied Theoretical Physics Division, and W. F. Hemsing and I. A. Garcia, Detonation Systems Group Dynamic Testing Division, Los Alamos National Laboratory, Los Alamos, N.M., pp. 299-305.

"A New Kind of Detonator—The Slapper", by J. R. Stroud, Lawrence Livermore Laboratory, University of California, Livermore, Calif., pp. 22-1 through 22-6.

"Shock Initiation of Explosive Pellets at Low Temperatures", by D. S. Gilman, Lawrence Livermore Laboratory, University of California, Livermore, Calif., pp. 41-1 through 41-5.

"Pyrotechnic Ignition in Minislapper Devices", by D. Grief and D. Powell, Awre, Aldermaston, Reading RG7 4PR, Berkshire, England, Controller, HMSO, London, 1981, pp. 43-1 through 43-10.

"Exploding Foils-The Production of Plane Shock Waves and the Acceleration of Thin Plates", by D. V. Keller and J. R. Penning, Jr., The Boeing Company, Seattle, Wash., pp. 263-277.

"Acceleration of Thin Plates by Exploding Foil Techniques", by A. H. Guenther, D. C. Wunsch and T. D. Soapes, Pulse Power Laboratory, Physics Division, Research Directorate Air Force Special Weapons Center, Kirtland Air Force Base, N.M., pp. 279-298.

FIG.1
(PRIOR ART)
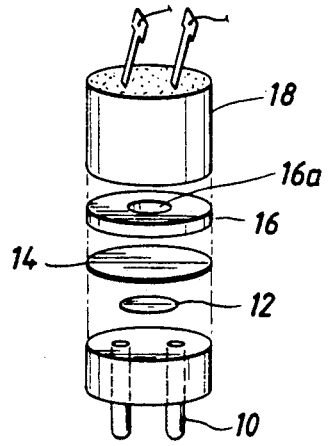
FIG.2a
(PRIOR ART)
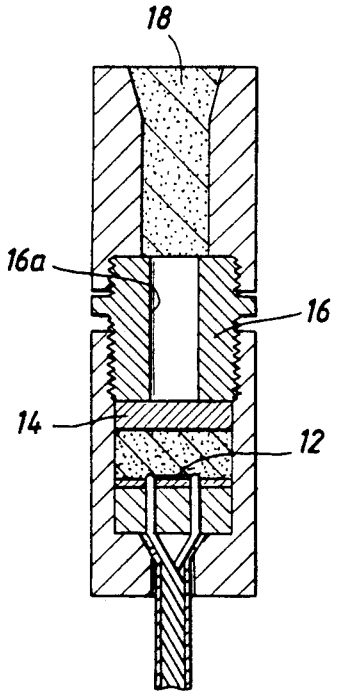
FIG.2b
(PRIOR ART)
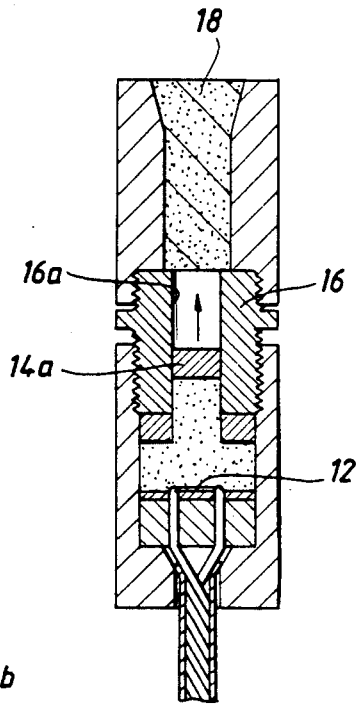
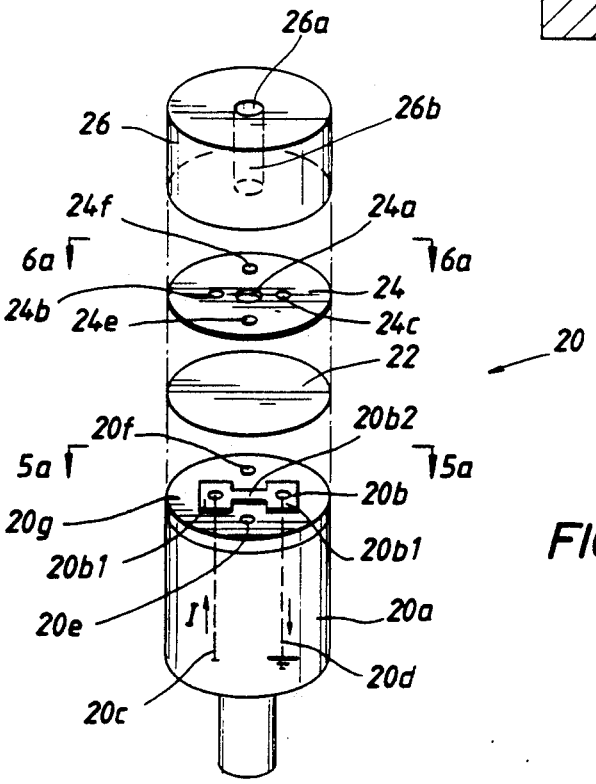
FIG.3

FIG.6a
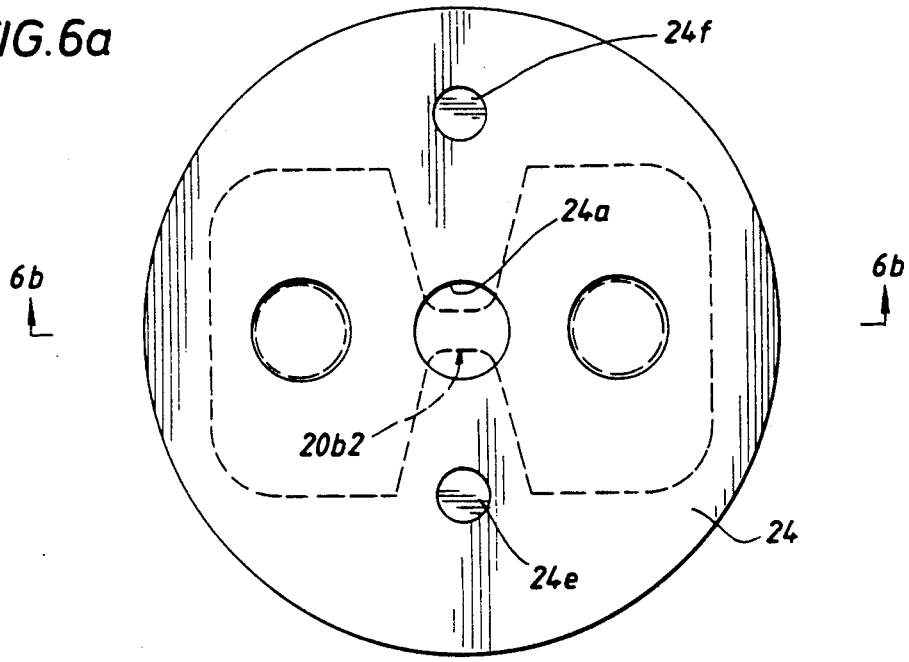
FIG.6b
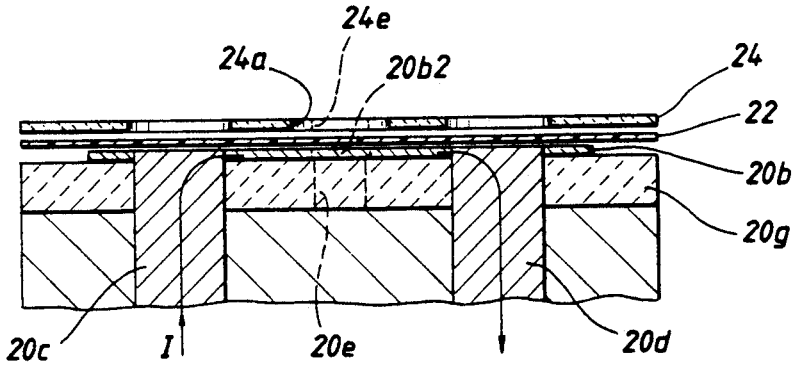
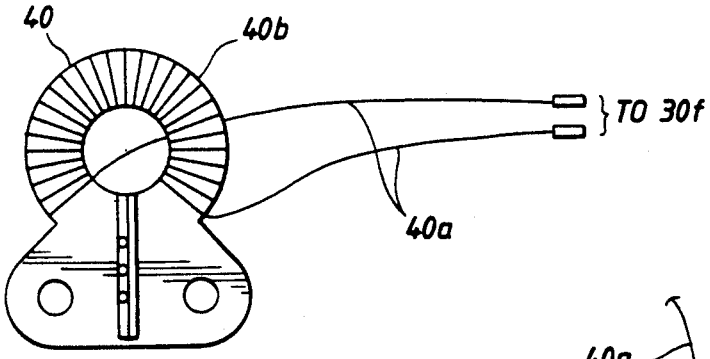
FIG.9a
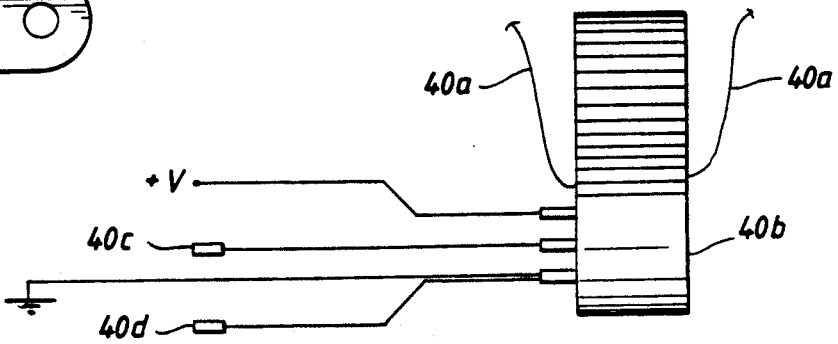
FIG.9b

FIG. 7a
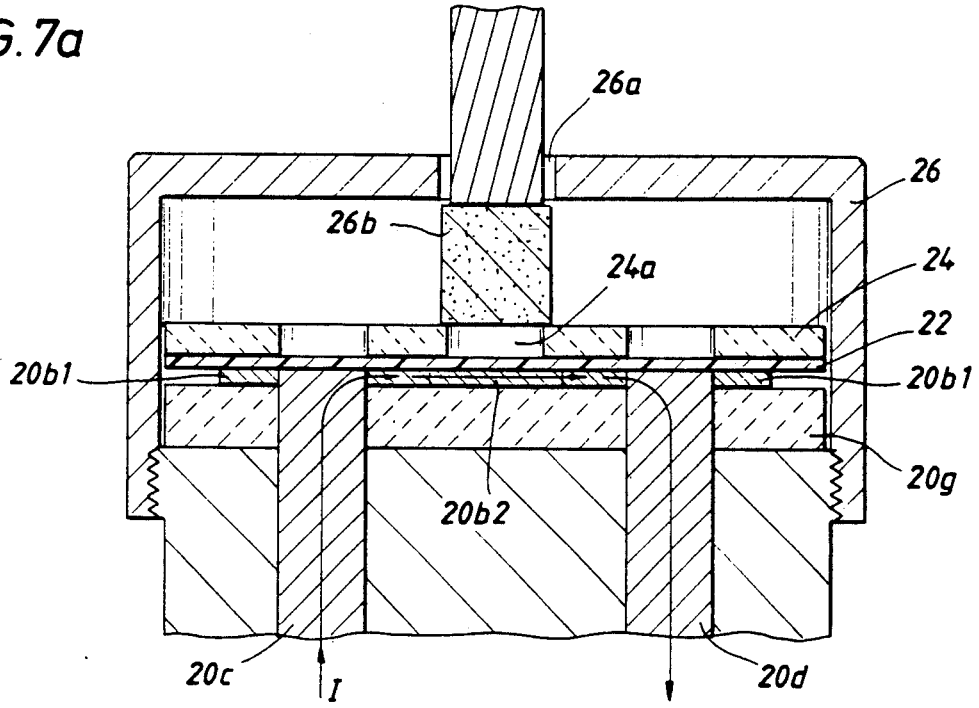
FIG. 7b
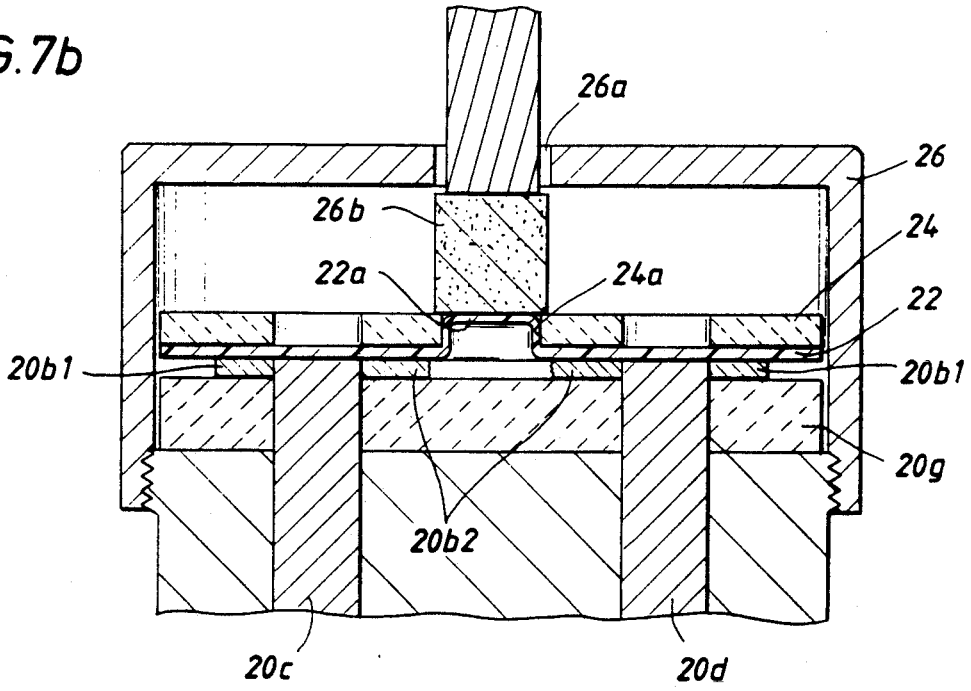
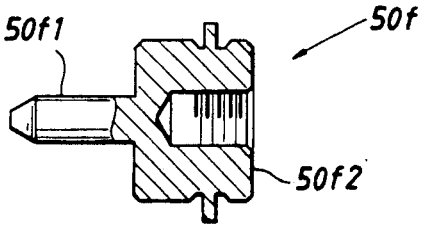
FIG. 11

METHOD AND APPARATUS FOR SAFE TRANSPORT HANDLING ARMING AND FIRING OF PERFORATING GUNS USING A BUBBLE ACTIVATED DETONATOR

BACKGROUND OF THE INVENTION

The subject matter of the present invention relates to detonators, and more particularly, to an exploding foil bubble activated (EFB) detonator for use in a perforating gun system, the bubble activated detonator including a polyimide layer adhesively secured to an exploding foil for expanding to form a bubble in response to a vaporization of a part of the foil, the bubble in the polyimide layer impacting a secondary explosive and detonating the explosive.

In the past, defense laboratories and related industries approached oil service companies to introduce a new detonator concept for use in perforating guns disposed in subsurface wells, an exploding foil initiator (EFI) detonator. The EFI detonator avoids the dangers associated with induced currents in primary highly sensitive explosives, the induced currents being produced when lead wires associated with arming apparatus in Electro Explosive Devices (EED) are exposed to electromagnetic fields originating from RF, radar, TV, and other electric transmissions. The EFI detonator is also termed the "flying plate" detonator, as illustrated in FIGS. 1, 2*a*, and 2*b* of the drawings and described in U.S. Pat. No. 4,788,913 to Stroud et al, entitled "Flying-Plate Detonator using a High Density High Explosive", the disclosure of which is incorporated by reference into this specification. The flying plate detonator includes a foil connected to a source of current, a small neck section of the foil exploding or vaporizing when a high current flows through the neck section of the foil. A disc is disposed in contact with the foil, the exploding neck section of the foil shearing a small flyer from the disc, the flyer travelling or flying through a barrel when sheared from the disc. The flyer impacts a secondary explosive and initiates a detonation of the secondary explosive. However, if the barrel is not centered correctly, an obstruction will appear between the disc and the secondary explosive. This obstruction will often prevent the flyer from impacting the secondary explosive. Therefore, when the flying plate EFI detonator is disposed in a perforating gun, this obstruction may prevent the perforating gun from detonating.

SUMMARY OF THE INVENTION

Accordingly, it is a primary object of the present invention to provide an alternative detonator apparatus, hereinafter termed an exploding foil bubble activated detonator for use in a perforating gun, which alternative detonator apparatus inherently includes all the advantages associated with the EFI detonator, but which does not include the disadvantages of the EFI detonator.

It is a further object of the present invention to design and provide the alternative detonator apparatus for use in perforating guns, the alternative detonator apparatus including an alternative initiator apparatus to be used in lieu of the flyer and barrel initiator apparatus associated with the prior art EFI detonator, the alternative initiator apparatus generating a bubble in response to vaporization of a neck section of an exploding foil, the bubble initiating the detonation of a secondary explosive.

It is a further object of the present invention to provide an alternative initiator apparatus which includes a polyimide layer deposited on the exploding foil and a spacer including a guiding hole deposited onto the polyimide layer, the polyimide layer developing a bubble in the vicinity of the neck section of the foil when the foil explodes or vaporizes, the bubble rising through the guiding hole in the spacer and impacting the secondary explosive at a velocity which is sufficient to detonate the explosive.

It is a further object of the present invention to provide a selective gun firing system for use in a perforating gun which contains a plurality of perforators, the selective gun firing system enabling the operator at a well surface to selectively fire the plurality of perforators in a predetermined sequence, such as the firing of the plurality of perforators sequentially starting with the bottom gun and ending with the top gun.

It is a further object of the present invention to provide the selective gun firing system for use in a perforating gun, the gun including the alternative detonator which utilizes the alternative initiator apparatus.

It is a further object of the present invention to provide a hall effect sensor apparatus, for use in a well truck disposed at a surface of a well, for sensing a current in a wireline to which the perforating gun is connected when disposed in a tubing in a wellbore, the hall effect sensor apparatus generating a current vs time output signal representing the current flowing in the wireline at any point in time.

It is a further object of the present invention to provide a safety barrier apparatus, for use with the prior art EFI detonator, the safety barrier being disposed in the barrel of the EFI detonator and providing a barrier whereby the flying plate impacts the barrier in the barrel when a safe-arm feature is needed to preclude premature detonation of the EFI detonator.

These and other objects of the present invention are accomplished by designing and providing an alternative detonator apparatus, the exploding foil bubble activated detonator (hereinafter termed the "EFB detonator") for use as a detonator in a perforating gun. The EFB detonator does not generate a flyer plate in a barrel in response to vaporization of the neck portion of the foil. In lieu of the flyer plate and the barrel normally associated with the prior art EFI detonator, the exploding foil bubble activated detonator for use as a detonator in a perforating gun, in accordance with the present invention, includes a polyimide layer deposited onto a foil bridge, which bridge is connected to a current source, and a spacer is deposited onto the polyimide layer, the spacer having a guiding hole in the center immediately above the neck portion of the foil. A secondary explosive pellet is disposed immediately above and adjacent to the guiding hole of the spacer. It is very important that the thickness of the polyimide layer be in the range of 0.001 plus or minus 0.00025 inch. It is also very important that the thickness of the spacer be in the range of 0.005 to 0.007 inch. When the neck section of the foil vaporizes or explodes in response to a high current flow through the foil, a bubble is formed between the neck portion of the foil and the polyimide layer as a result of the turbulence produced from the vaporized foil neck section. The bubble causes the polyimide layer to expand into the guiding hole in the spacer, the polyimide layer continuing to advance toward the secondary explosive pellet as a result of the explosion of the foil neck portion. Eventually, the polyimide layer expands to a point where it impacts the secondary explosive with enough force to cause the explosive to detonate. Detonation of the explosive further ignites or detonates a detonating cord or other such material connected to the secondary explosive. The detonating cord may be further connected to a plurality of charges in a perforating gun. Since a bubble was formed as a result of vaporization of the foil neck section, and the bubble was guided toward the explosive via the guiding hole in the spacer, no centering or alignment problem is created or produced, which problem was evident from use of the prior art exploding foil, flyer and barrel approach in the prior art EFI detonator. As a result, a more reliable exploding foil initiator detonator is created. In addition, the perforating gun which includes the EFB detonator further includes a plurality of perforators and a selective gun firing system. The selective gun firing system includes the EFB detonator and allows a user to fire the perforators in a predetermined sequence.

Further scope of applicability of the present invention will become apparent from the detailed description presented hereinafter. It should be understood, however, that the detailed description and the specific examples, while representing a preferred embodiment of the invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinafter, and the accompanying drawings, which are given by way of illustration only and are not intended to be limitative of the present invention, and wherein:

FIG. 1 illustrates a sketch of the prior art apparatus and method of detonation using an exploding foil initiator (EFI) including a flying plate and a barrel for guiding the flying plate;

FIG. 2*a* and 2*b* illustrates another sketch of the prior art method of detonation using EFI and the flying plate;

FIG. 3 is a sketch of the EFB apparatus in accordance with the present invention using an EFI without the flying plate or barrel;

FIGS. 6*a*-6*b* illustrate a cross sectional view of the EFB apparatus of FIG. 3 taken along section lines 6—6 of FIG. 3 and further illustrating a front view of this sectional view;

FIG. 7*a* illustrates a front longitudinal sectional view of the EFB apparatus of FIG. 3 before vaporization or explosion of the neck section of the foil bridge;

FIG. 7*b* illustrates a front longitudinal sectional view of the EFB apparatus of FIG. 3 after vaporization or explosion of the neck section of the foil bridge, showing the bubble formed by the polyimide layer for initiating the detonation of the secondary explosive;

FIGS. 9*a*-9*b* illustrate a hall effect current sensor for use in a well logging truck which senses the current in the wireline connected to the perforating gun and to the EFB detonator apparatus in the selective gun firing system;

FIG. 11 illustrates a safety barrier which is inserted into a port through a wall of a firing head assembly, the safety barrier being inserted after a port plug is removed, the safety barrier including a steel rod for blocking the flying plate in the conventional EFI detonator.

DETAILED DESCRIPTION OF THE PREFERRED EMBODIMENT

Figure 4:
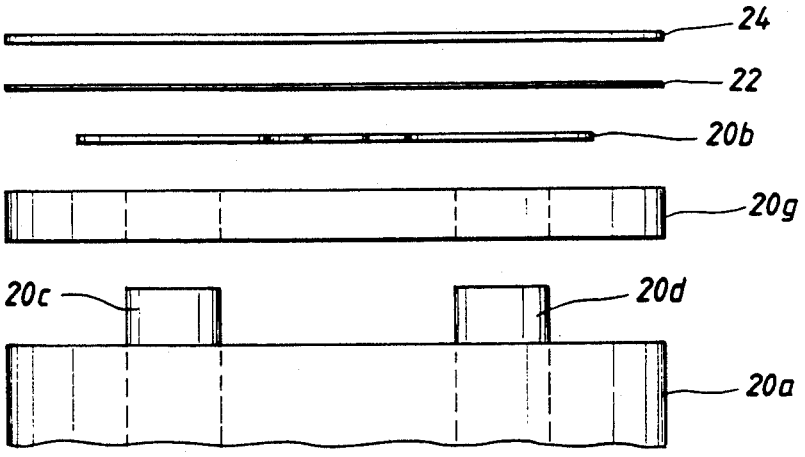
FIG. 4 illustrates the layers of material shown in FIG. 3.

A discussion of the exploding foil bubble activated detonator (EFB detonator), for use in a perforating gun, in accordance with one aspect of the present invention, is set forth in the following paragraphs with reference to FIGS. 1-7*b* of the drawings.

Referring to FIG. 1, a prior art apparatus is illustrated for detonating a secondary explosive using an Exploding Foil Initiator (EFI), a flying plate and a barrel for guiding the flying plate. In FIG. 1, a pair of electrodes 10 energize a foil 12 by flowing a current through the foil. A disc 14, such as a plastic disc, is disposed adjacent the foil 12. A barrel 16 is disposed adjacent the disc 14, the barrel 16 having a hole 16*a* therein for guiding a flying plate which is sheared from the disc 14 when the foil 12 vaporizes in response to a current flowing therethrough. A secondary explosive 18, such as HNS or PETN, is disposed adjacent the barrel 16 for receiving the flying plate and detonating when the flying plate impacts the explosive. In operation, when current of sufficient magnitude flows through foil 12, a neck portion of foil 12 vaporizes thereby causing a flying plate to be sheared from the disc 14. The flying plate is guided by the hole 16*a* in barrel 16, the flying plate impacting the secondary explosive 18, detonating the explosive.

FIGS. 2*a* and 2*b* illustrate the concept, set forth above with reference to FIG. 1, in more detail. FIGS. 2*a* and 2*b* are discussed in detail in U.S. Pat. No. 3,978,791 to Lemley et. al, the disclosure of which is incorporated by reference into this specification. Flying plate detonators, of the type shown in FIGS. 1, 2*a*, and 2*b*, are also discussed in detail in U.S. Pat. No. 4,788,913 to Stroud et. al, the disclosure of which is incorporated by reference into this specification. In FIG. 2*a*, the disc 14 is disposed adjacent the foil 12, and a current flows through the foil 12. A flying plate has not yet been formed. In FIG. 2*b*, a flying plate 14*a* is sheared from disc 14 when a current of sufficient magnitude and duration flows through the foil 12. The flying plate 14*a* is guided by hole 16*a* of barrel 16 during its flight through the barrel. The impact of the flying plate 14*a* on the secondary explosive 18 detonates the explosive 18.

In the FIG. 1, 2*a*, and 2*b* prior art embodiments, the barrel 16 must be centered directly above the disc 14 and the foil 12. If the barrel is not centered directly above the disc 14 and the foil 12, the barrel itself will act as an obstruction to the flight of the flying plate 14a within the barrel.

Referring to FIG. 3, an exploding foil bubble activated (EFB) detonator apparatus 20 for use in a perforating gun, in accordance with the present invention, is illustrated.

In FIG. 3, the EFB detonator 20 includes a base part 20a in which a current "I" flows. A ceramic disc 20g is first deposited or disposed over the top of base part 20a. A foil bridge 20b is disposed over the ceramic disc 20g, the foil 20b including an enlarged part 20b1 on both ends and a small neck section 20b2 interconnected between the two enlarged parts 20b1. A first conductor 20c is disposed through ceramic disc 20g and a second conductor 20d is also disposed through ceramic disc 20g, the first conductor 20c conducting the current "I" toward one enlarged part 20b1 of foil 20b, and the second conductor 20d is adapted for conducting a return current away from the other enlarged part 20b1 of foil 20b to ground potential. When a current "I" of sufficient magnitude and duration flows through the small neck section 20b2, the neck section 20b2 explodes or vaporizes, causing a turbulence to occur in the vicinity of the neck section. This turbulence is ultimately responsible for implementing the positive benefits and advantages in accordance with the present invention, which benefits and advantages will be explained in more detail in the following paragraphs. A first dot 20e appears on the top of base part 20a and a second dot 20f appears on the top of base part 20a, opposite the first dot 20e. The dots 20e and 20f are used for alignment purposes, which will be explained in more detail below. A polyimide layer 22 is disposed over the top of base part 20a. One type of polyimide material, which may be used as the polyimide layer 22, is known as "Kapton". The Kapton polyimide material is manufactured by E.I. DuPont De Nemours, Incorporated (Dupont). The polyimide layer 22 must be approximately 0.001 inch in thickness; to be more specific, the layer 22 must be 0.001 plus or minus 0.00025 inch in thickness. The thickness of layer 22 is an important parameter for reasons which will become apparent from the functional description of the invention set forth in the following paragraphs. A spacer 24 is deposited or disposed over the polyimide layer 22. The spacer 24 is made of a ceramic material and is approximately 0.005 inch in thickness; to be more specific, the spacer 24 is 0.005 to 0.007 inch in thickness. The thickness of the spacer 24 is also a very important parameter, for reasons which will also become apparent from the functional description of the invention set forth below. The spacer 24 includes a center hole 24a which is disposed immediately above the small neck section 22b2 of foil 20b. Spacer 24 also includes alignment holes 24e and 24f which are adapted to be disposed directly above dots 20e and 20f on the base part 20a. When spacer 24 is deposited or disposed over polyimide layer 22, the spacer 24 must be positioned or aligned properly over layer 22 and foil 20b, the proper alignment being achieved when alignment holes 24e and 24f are disposed immediately above dots 20e and 20f, in a concentric fashion. Spacer 24 further includes holes 24b and 24c which, when aligned properly as described above, will be positioned directly above conductors 20c and 20d in base part 20a. A cap 26 is adapted to be disposed over spacer 24, layer 22, and foil 20b, and is adapted to be threadedly connected to base part 20a. Cap 26 includes a hole 26a which is concentrically disposed directly over center hole 24a of spacer 24. An explosive pellet 26b, such as HNS, is dropped into hole 26a of cap 26, the pellet resting on spacer 24 and directly over center hole 24a. The positioning of pellet 26b directly over center hole 24a is important in implementing the bubble activated detonation in accordance with the present invention.

Referring to FIG. 4, a side view of the EFB detonator 20 is illustrated, specifically illustrating base part 20a with conductors 20c and 20d, ceramic disc 20g, foil bridge 20b, polyimide layer 22, and spacer 24. The base part 20a includes conductors 20c and 20d, the conductors being 0.034 inch diameter pins. The ceramic disc 20g is 0.025 inches in thickness, and includes two holes adapted for receiving the conductors 20c and 20d, each hole being approximately 0.044 inch in diameter. The foil bridge 20b is approximately 0.170 mils in thickness, plus or minus 0.005 inches. The polyimide layer 22 is approximately 0.001 inch in thickness, plus or minus 0.00025 inch. The thickness of the polyimide layer 22 is critical and should be observed carefully to ensure that the thickness lies within the stated range. The spacer 24 is preferably made of a ceramic material and is approximately 0.005 to 0.007 inch in thickness. The thickness of the spacer 24 is also critical and must lie within the stated range. The center hole 24a of spacer 24 is approximately 0.040 inch in diameter. The two other holes 24b and 24c in spacer 24 which lie directly above the conductor 20c and 20d are approximately 0.060 inch in diameter.

Figure 5A:
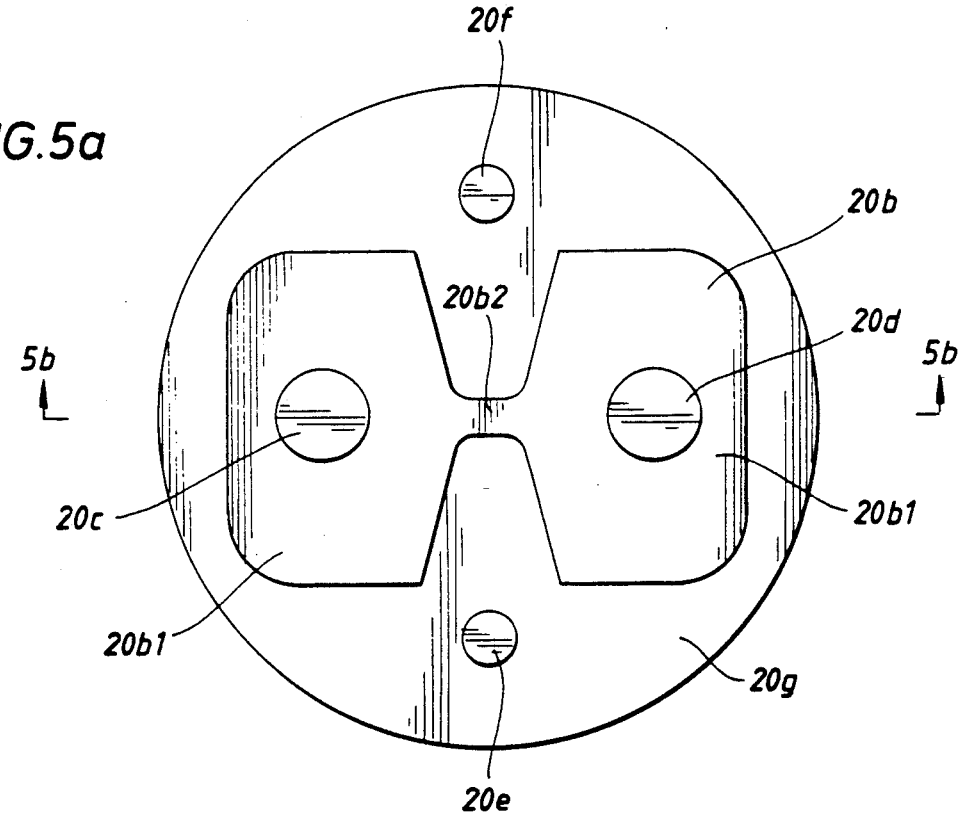
FIGS. 5*a*-5*b* illustrate a cross sectional view of the EFB apparatus of FIG. 3 taken along section lines 5—5 of FIG. 3 and further illustrating a front view of this sectional view.
Figure 5B:
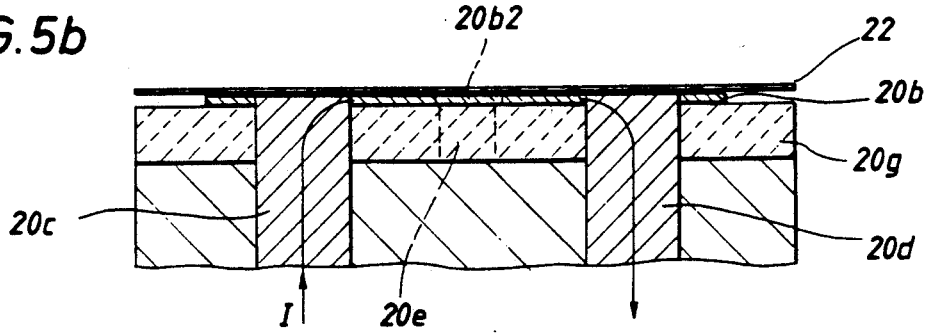

Referring to FIGS. 5a–5b, a top view of the EFB detonator 20 of FIG. 3 is illustrated taken along section lines 5a—5a of FIG. 3. In FIG. 5a, the ceramic disc 20g, including dots 20e/20f, is illustrated. Two conductors 20c and 20d extend through the ceramic disc 20g, as shown more clearly in FIG. 5b. The conductors also extend through holes in the foil bridge 20b, and in particular, through enlarged parts 20b1 of the foil bridge 20b, so as to create an electrical connection between conductor 20c, enlarged part 20b1, small neck section 20b2 of the foil bridge 20b, enlarged part 20b1, and conductor 20d. A polyimide layer 22 is disposed over the foil bridge 20b, as noted in FIG. 5b. When a current of sufficient magnitude and duration flows through the small neck section 20b2 of foil bridge, from conductor 20c to conductor 20d, the neck 20b2 vaporizes or explodes. This causes a turbulence to occur under polyimide layer 22 directly above the neck section 20b2 of foil bridge 20b. This turbulence will cause the polyimide layer 22, immediately above the neck section 20b2, to expand, stretch and form a bubble. The bubble will cause the detonator of the present invention to detonate. This function will be explained more clearly with reference to FIGS. 7a–7b.

Referring to FIGS. 6a–6b, a top view of the EFB detonator 20 of FIG. 3 is illustrated taken along section lines 6—6 of FIG. 3. In FIG. 6a, the spacer 24 is deposited onto, and covers the ceramic disc 20g, foil bridge 20b, and the polyimide layer 22 of FIG. 5a/5b. In the above paragraph, it was indicated that a bubble is formed immediately above the neck section 20b2. The shape, size, and general form of the bubble is defined by the center hole 24a of spacer 24. Since the center hole 24a is centered immediately above neck section 20b2, and immediately below the explosive pellet 26b, the carefully formed bubble, formed by center hole 24a, will detonate the pellet 26b. This function will be explained more clearly with reference to FIGS. 7a and 7b.

A functional description of the EFB detonator apparatus, for use in a perforating gun, in accordance with the present invention, is set forth in the following paragraphs with reference to FIGS. 7*a* and 7*b* of the drawings.

In FIG. 7*a*, a large current propagates through conductor 20*c* and into foil bridge 20*b*/20*b*1. The current flows through neck section 20*b*2 and into conductor 20*d*. The polyimide layer 22 is disposed over the foil bridge 20*b*, and the spacer 24, with center hole 24*a*, is disposed over polyimide layer 22. An explosive pellet 26*b* is disposed immediately above the center hole 24*a* of spacer 24. A detonating cord is connected to the explosive pellet for propagating a detonating wave to other parts of a system. A typical system may, for example, be a perforating gun of a well tool used in oil well boreholes. The detonating cord, in this example, would be connected to a plurality of shape charges disposed in the perforating gun.

In FIG. 7*b*, the small neck section 20*b*2 of foil bridge 20*b* explodes or vaporizes when the large current of sufficient magnitude or duration flows through the neck section 20*b*2. When the neck section 20*b*2 vaporizes, a turbulence occurs in the space between the neck section 20*b*2 of foil bridge 20*b* and the polyimide layer 22. This turbulence causes the polyimide layer 22 to expand and form a bubble 22*a*, the bubble 22*a* impacting the explosive pellet 26*b*. The shape and size of the bubble 22*a* is controlled by the shape and size of the center hole 24*a* in the spacer 24. However, the turbulence, in the space between the neck section 20*b*2 and the polyimide layer 22, caused by vaporization of the neck section 20*b*2, is sufficient in intensity to cause the bubble to form and expand at a rapid rate, the rate of expansion of the bubble 22*a* being enough to cause the explosive pellet 26*b* to detonate when the bubble impacts the pellet 26*b*. When the pellet 26*b* detonates, the detonating cord, connected to the pellet, conducts a detonating wave to another system, such as to the shape charges in a perforating gun, used to perforate a formation of an oil well borehole.

Figure 8:
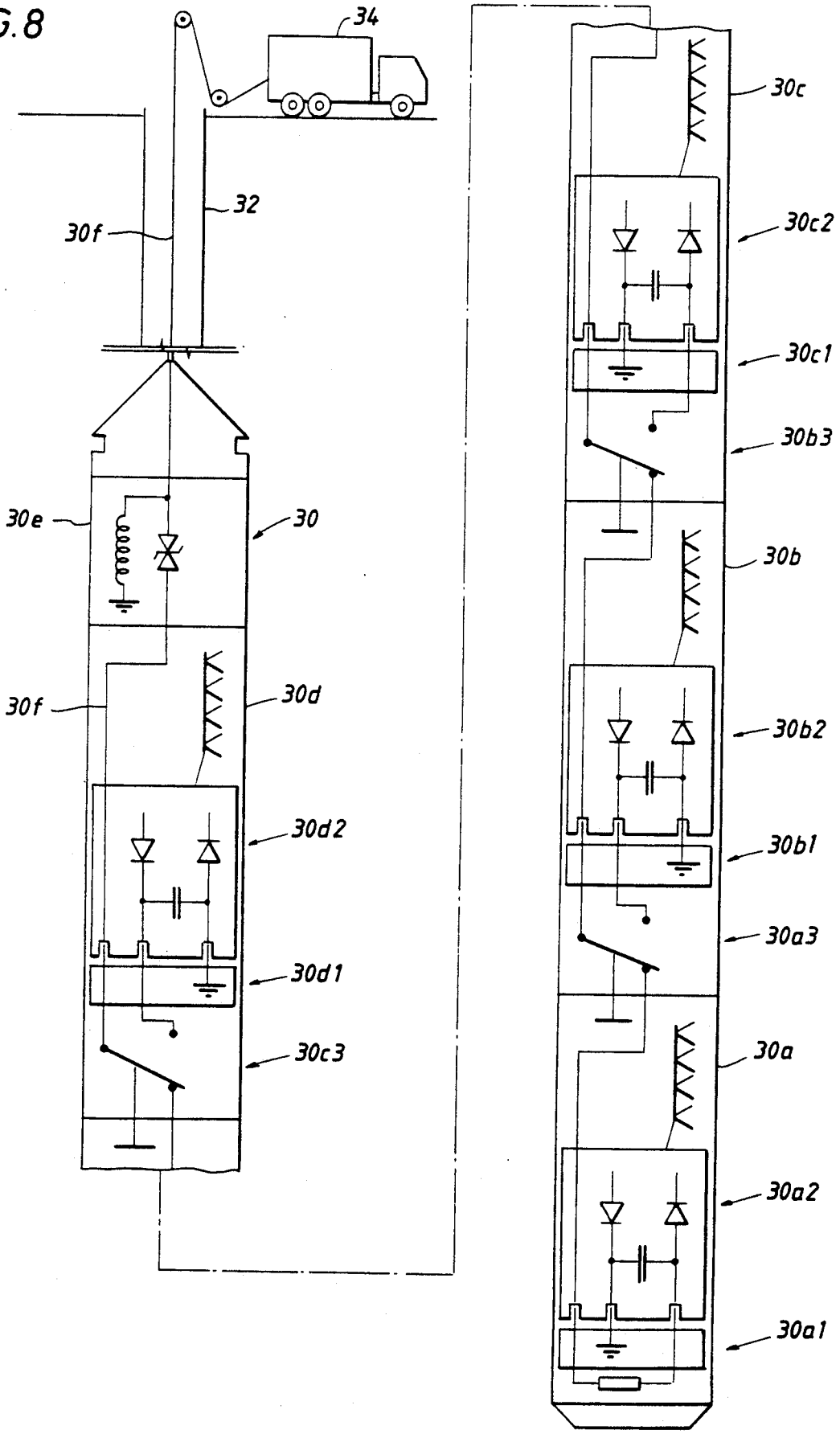
FIG. 8 illustrates a perforating gun including a plurality of perforators, the perforating gun including a selective gun firing system, the selective gun firing system including the EFB apparatus of FIGS. 3-7B.

Referring to FIG. 8, a perforating gun including a plurality of perforators is illustrated, the perforating gun including a selective gun firing system in accordance with another aspect of the present invention, the selective gun firing system including the EFB apparatus of FIGS. 3-7B.

In FIG. 8, a perforating gun 30, connected to a well truck 34 at a surface of a borehole, is lowered into a tubing 32 by wireline 30*f* and includes a plurality of perforators and a selective gun firing system. The plurality of perforators include perforator 30*a* (gun 1), perforator 30*b* (gun 2), perforator 30*c* (gun 3), and perforator 30*d* (gun 4), each perforator including a plurality of charges. The selective gun firing system of FIG. 8 is associated with each of the guns 1-4 and includes:

(1) associated with gun 1 30*a* - a selector plug (red) (1) 30*a*1 (selector plug-1 30*a*1), an exploding Secondary Initiating Cartridge (ESIC) which includes an exploding foil bubble activated detonator (EFB) (1) 30*a*2 (ESIC/EFB-1 30*a*2), and a monoswitch (1) 30*a*3;

(2) associated with gun 2 30*b* - a selector plug (green) (2) 30*b*1 (selector plug-2 30*b*1), an Exploding Secondary Initiating Cartridge (ESIC) which includes an exploding foil bubble activated detonator (EFB) (2) 30*b*2 (ESIC/EFB-2 30*b*2), and a monoswitch (2) 30*b*3;

(3) associated with gun 3 30*c* - a selector plug (red) (3) 30*c*1 (selector plug-3 30*c*1), an Exploding Secondary Initiating Cartridge (ESIC) which includes an exploding foil bubble activated detonator (EFB) (3) 30*c*2 (ESIC/EFB-3 30*c*2), and a monoswitch (3) 30*c*3; and (4) associated with gun 4 30*d* - a selector plug (green) (4) 30*d*1 (selector plug-4 30*d*1), and an Exploding Secondary Initiating Cartridge (ESIC) which includes an exploding foil bubble activated detonator (EFB) (4) 30*d*2 (ESIC/EFB-4 30*d*2); there is no monoswitch associated with gun 4 30*d*.

Each ESIC/EFB 1-4 30*a*2-30*d*2 as described above, which forms a part of the selective gun firing system, contains the exploding foil bubble activated detonator (EFB detonator 20 of FIGS. 3- 7*b*) described above in this specification with reference to FIGS. 1-7*b* of the drawings. Each ESIC/EFB 1-4 30*a*2-30*d*2 has a positive input terminal connected to a selector plug (red) 30*a*1 and 30*c*1 and a negative input terminal connected to a selector plug (green) 30*b*1 and 30*d*1. The positive input terminal of each ESIC/EFB is connected, via a diode and capacitor network as illustrated in FIG. 8, to lead 20*d* of the EFB detonator 20 of FIG. 3; the negative input terminal of each ESIC/EFB is connected, via the diode and capacitor network, to lead 20*c* of the EFB detonator 20 of FIG. 3.

Each monoswitch 30*a*3-30*c*3 is disposed in one of two positions, the position shown in FIG. 8 (hereinafter termed "position 1") and its alternate position not shown in FIG. 8 (hereinafter termed "position 2"). In operation, when the perforator associated with each switch detonates its charges, the particular switch changes positions from position 1 to position 2. For example, when perforator 30*a* detonates, monoswitch-1 30*a*3 changes its position from position 1 (shown in FIG. 8) to position 2 (not shown in FIG. 8).

The wireline 30*f* lowers the perforating gun 30 into a tubing 32 disposed in a borehole, the wireline 30*f* being connected on one end to the perforating gun 30 and on the other end to a well logging truck 34. The wireline 30*f*, which is connected to the perforating gun 30, is also disposed within the perforating gun 30 and is connected to guns 1-4 30*a*-30*d* via monoswitches 1-3 30*a*3, 30*b*3, and 30*c*3. A casing collar locator (CCL) 30*e* is disposed within the perforating gun 30 and interconnects the wireline 30*f* connected to the well truck 34 to the wireline 30*f* connected to the guns 1-4 30*a*-30*d*. The CCL 30*e* detects the presence of the threaded joints disposed between sections of the tubing 32 by detecting changes in magnetic field flux at each of the threaded joints thereby determining the depth of the perforating gun 30 when the gun 30 is being lowered into the tubing 32.

A functional operation of the selective gun firing system disposed in perforating gun 30 is set forth in the following paragraphs with reference to FIG. 8 of the drawings.

Selectivity, in the context of a selective gun firing system, is a means of selectively firing one gun string at a time starting from the bottom gun (gun 1 30*a*). Gun 1 30*a* is triggered using a positive voltage, gun 2 30*b* is triggered using a negative voltage, gun 3 30*c* is triggered using a positive voltage, etc. Power in the form of a positive voltage is routed by wireline 30*f* from the well truck 34 to gun 1 30*a* (the bottom gun) via CCL 30*e*, gun 4 30*d*, gun 3 30*c*, gun 2 30*b*, and selector plug-1 30*a*1. The selector plug-1 30*a*1 energizes the positive terminal of the ESIC/EFB-1 30*a*2 with the positive voltage. In response, the EFB detonator in the ESIC-/EFB-1 30*a*2 detonates the charges within the gun 1 30*a*. Monoswitch-1 30*a*3 was originally in position 1 as shown in FIG. 8, but changes its position to position 2 in response to detonation of the charges in gun 1 30*a*. However, since a positive voltage is still being propagated through wireline 30*f*, the charges in gun 2 fail to detonate. When the positive voltage is changed to a negative voltage by the operator at the well surface (in well truck 34), the selector plug-2 30*b*1 receives the negative voltage from monoswitch-1 30*a*3 and energizes the negative terminal of the ESIC/EFB-2 30*b*2 with the negative voltage thereby detonating the EFB detonator 20 in the ESIC/EFB-2 and detonating the charges in the gun 2 30*b*. In response to detonation of the charges in gun 2, monoswitch-2 30*b*3 changes its position from position 1, as shown in FIG. 8, to position 2 thereby allowing the negative voltage to energize the positive terminal of selector plug-3 30*c*1; however, since the ESIC/EFB-3 30*c*2 reacts to a positive voltage, and not a negative voltage, no detonation of gun 3 occurs. When the operator in well truck 34 changes the voltage from negative to positive, the EFB detonator 20 disposed within the ESIC/EFB-3 30*c*2 detonates the charges in gun 3 30*c*. In response to detonation of gun 3 30*c*, monoswitch-3 30*c*3 changes its position from position 1, as shown in FIG. 8, to position 2 thereby energizing the negative terminal of selector plug-4 30*d*1 and ESIC/EFB-4 30*d*2 with the positive voltage. However, no detonation of gun 4 occurs since the voltage is still positive. When the operator changes the voltage from positive to negative, the EFB detonator 20 disposed within the ESIC/EFB-4 30*d*2 detonates the charges in gun 4. When the charges in gun 4 30*d* detonate, the wireline 30*f* in gun 4 30*d* slams against the housing of the perforating gun 30, thereby creating a short circuit and ending the detonation sequence.

Therefore, the selective gun firing system of FIG. 8 allows an operator in the well truck 34 to selectively fire a plurality of perforators disposed within a perforating gun in a predetermined sequence, such as from bottom gun (gun 1) to top gun (gun 4). The EFB detonators 20 of FIGS. 1–7*b* disposed within each ESIC cartridge 30*a*2, 30*b*2, 30*c*2, and 30*d*2 of the perforating gun 30 perform more efficiently relative to the prior art EFI detonator.

Referring to FIGS. 9*a*–9*b*, a hall effect current sensor 40, disposed within the well truck 34, senses the current in the wireline 30*f* connected to the perforating gun 30 and to the EFB detonators 20 in the selective gun firing system.

In FIG. 9*a*, a front view of the hall effect sensor 40 is illustrated. The sensor 40 comprises a 22 awg stranded, teflon insulated wire 40*a* wrapped around a ferrite split donut core 40*b*. In FIG. 9*b*, a side view of the sensor 40 is illustrated. The wires 40*a* are again shown as wrapped around the ferrite split donut core 40*b*. Two output wires 40*c* and 40*d* receive signals from the core 40*b* and generate output signals which represent the current in the wireline 30*f*.

The monitoring of current in wireline 30*f* using a hall effect sensor 40 provides excellent current sensitivity and isolation between the sensitive wireline 30*f* and the instrumentation in the well truck 34. The donut core 40*b* forms a magnetic path for the sensor when a current carrying wire 40*a* is threaded through the center of the core. Current amplification is accomplished by threading the current wire 40*a* through the core 40*b* numerous times. The output is monitored using an A/D converter along with a computer and a cathode ray tube to produce a visible nomogram for wireline current as well as being stored on a nonerasable media for further evaluation. This record of current vs time, provided by the output signals present in output wires 40*c* and 40*d* of FIG. 9*b*, becomes important in diagnosing misfires and near failures even before the gunstring is out of the borehole. For scallop guns, the current provides an excellent indication for shot detection.

Figure 10:
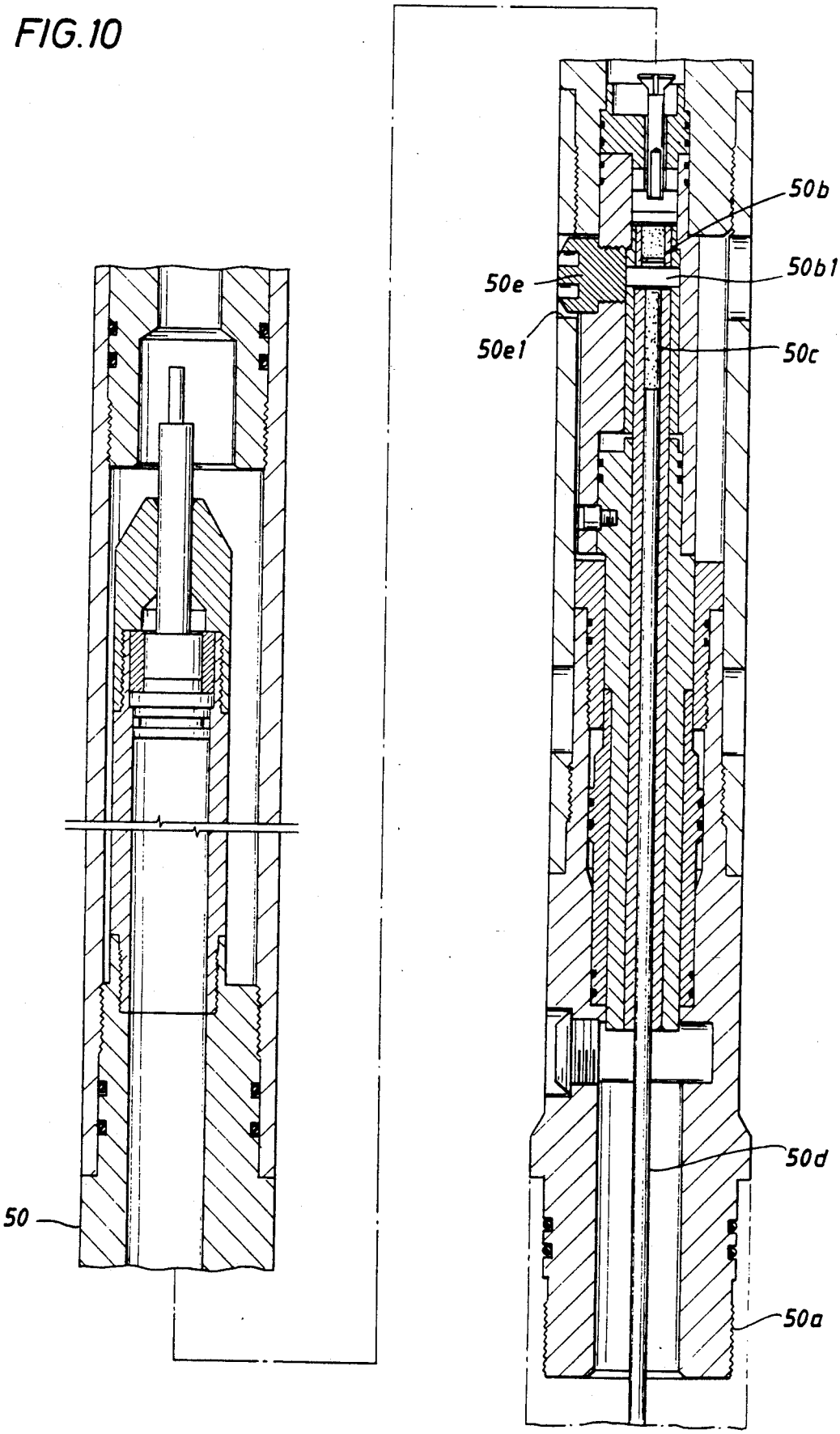
FIG. 10 illustrates a firing head assembly adapted to be connected to a perforating gun, the firing head assembly including the conventional EFI detonator, the EFI detonator including a port plug which, when removed, enables a steel rod to be inserted in the barrel of the EFI detonator thereby providing a safety barrier and a safe-arm feature for the detonator.

Referring to FIG. 10, a firing head assembly adapted to be connected to a perforating gun is illustrated, the firing head assembly including the conventional EFI detonator, the EFI detonator including a port plug which, when removed, enables a steel rod to be inserted in the barrel of the EFI detonator thereby providing a safety barrier and a safe-arm feature for the detonator.

In FIG. 10, the firing head assembly 50 includes a lower gun head 50*a* to which a perforating gun, such as the perforating gun 30 of FIG. 8, is connected. A conventional, prior art EFI detonator assembly 50*b* of FIGS. 1, 2*a* and 2*b* is disposed within the firing head assembly 50. The EFI detonator assembly 50*b* includes a barrel and a hole 50*b*1 similar to barrel 16 and hole 16*a* of FIGS. 1, 2*a* and 2*b*. A booster 50*c* is disposed within the firing head assembly 50 immediately below the barrel and hole 50*b*1 of the EFI assembly 50*b*. A detonating cord 50*d* is connected to the booster 50*c*, on one end, and to the charges within the perforating gun (such as gun 30). A port plug 50*e* is disposed through a port 50*e*1 in a wall of the firing head assembly 50 immediately adjacent the hole 50*b*1 of the EFI assembly 50*b*. The port 50*e*1 is a hole which is drilled completely through the wall of the firing head assembly 50 so as to expose the hole 50*b*1 of the EFI assembly 50.

When the port plug 50*e* is removed, in accordance with one aspect of the present invention, a safety barrier 50*f* (shown in FIG. 11), which includes a steel rod, is inserted into the port 50*e*1 of the wall of the firing head assembly 50 and into the hole 50*b*1 of the EFI assembly 50*b* so as to completely block the hole 50*b*1 of the EFI assembly. This action is similar to insertion of a steel rod in hole 16*a* of the EFI detonator of FIG. 2*b* thereby completely blocking the hole 16*a* of barrel 16 in FIG. 2*b*. The steel rod functions as a safety barrier.

Referring to FIG. 11, the safety barrier 50*f* including a steel rod 50*f*1 is illustrated.

In FIG. 11, the safety barrier 50*f* includes a port plug section 50*f*2 and the steel rod 50*f*1 integrally connected to the port plug section 50*f*2. When the port plug 50*e* is removed from the firing head assembly 50 of FIG. 10, the safety barrier 50*f* of FIG. 11 is inserted in its place. When the safety barrier 50*f* is completely inserted, the steel rod 50*f*1 is disposed within the hole 50*b*1 and completely blocks the hole 50*b*1 of the EFI assembly 50*b*.

In operation, referring alternately to FIG. 10 and FIGS. 2*a* and 2*b*, if the EFI detonator 50*b* of FIG. 10 accidentally detonates, a flyer plate (14*a* of FIG. 2*b*) is sheared off from a disc (14 of FIG. 2*a*). The flyer plate (14*a* of FIG. 2*b*) begins to fly through a hole (16*a* of FIG. 2*b*) in barrel (16 in FIG. 2*b*). However, when the steel rod safety barrier is inserted into the port 50*e*1 of the wall of firing head assembly 50 and into hole 50*b*1 of the EFI assembly 50*b* so as to completely block the hole 50*b*1 of FIG. 10, the flyer plate (14*a*) hits the steel rod safety barrier and not the booster 50*c* of FIG. 10. The steel rod safety barrier provides a safe-arm feature; if the EFI detonator accidentally detonates, when the safety barrier is in place within hole 50*b*1 as described above, an accidental detonation of the perforating gun (e.g., gun 30) cannot occur.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A perforating gun including a system, the system including an explosive, said system comprising:
- a first conductor adapted for conducting a current;
- a second conductor adapted for receiving said current;
- a foil interconnected between the first conductor and the second conductor, said foil including a bridge means for vaporizing when said current flows therethrough;
- a first layer deposited over said foil; and
- a spacer layer deposited over said first layer and disposed between said first layer and said explosive, said spacer layer including a hole disposed directly above said bridge means;
- said first layer expanding to form a bubble when said bridge means vaporizes,
- said bubble impacting and detonating said explosive during the expanding of said first layer.

2. The system of claim 1, wherein said hole in said spacer layer guides and forms said bubble into a predetermined shape and size during the expanding of said first layer, the shaped and sized bubble impacting and detonating said explosive.

3. A method practiced by a detonator in a perforating gun for detonating an explosive, comprising the steps of:
- flowing a current through a foil thereby vaporizing a portion of said foil;
- expanding a portion of a layer of material disposed adjacent said foil thereby forming a bubble in said portion of said layer of material when said portion of said foil vaporizes, said portion of said layer of material corresponding to said portion of said foil being vaporized;
- forcing said bubble through a hole in a spacer layer disposed adjacent said layer of material thereby shaping and sizing said bubble during the expansion of said portion of said layer of material; and
- allowing the shaped and sized bubble in said portion of said layer of material to impact said explosive thereby detonating said explosive.

4. A perforating gun including a detonator, said detonator including an explosive, said detonator comprising:
- a first conductor adapted for conducting a current;
- a second conductor adapted for receiving said current;
- a foil interconnected between the first conductor and the second conductor, said foil including a bridge means for vaporizing when said current flows therethrough;
- a first layer deposited over said foil; and
- a spacer layer deposited over said first layer and disposed between said first layer and said explosive, said spacer layer including a hole disposed directly above said bridge means;
- said first layer expanding to form a bubble when said bridge means vaporizes,
- said bubble impacting and detonating said explosive during the expanding of said first layer.

5. The detonator of claim 6, wherein said hole in said spacer layer guides and forms said bubble into a predetermined shape and size during the expanding of said first layer, the shaped and sized bubble impacting and detonating said explosive.

6. A perforating gun including a detonator, said detonator including an explosive, said detonator comprising:
- a first conductor adapted for conducting a current;
- a second conductor adapted for receiving said current;
- a ceramic layer;
- a foil disposed over said ceramic layer and interconnecting said first conductor to said second conductor, said foil including a bridge means for vaporizing when said current flows therethrough;
- a first layer deposited over said foil; and
- a spacer layer deposited over said first layer and disposed between said first layer and said explosive, said spacer layer including a hole disposed directly above said bridge means,
- said first layer expanding to form a bubble when said bridge means vaporizes,
- said bubble impacting and detonating said explosive during the expansion of said first layer.

7. The detonator of claim 6, wherein said hole in said spacer layer guides and forms said bubble into a predetermined shape and size during the expanding of said first layer, the shaped and sized bubble impacting and detonating said explosive.

8. A system including a perforating gun and a current carrying conductor connected to the perforating gun for conducting a current of a first polarity and a current of a second polarity when said gun is disposed in a borehole, said perforating gun including a selective firing system, the selective firing system comprising:
- a plurality of perforators, each of said plurality of perforators including a detonator connected to said current carrying conductor and a plurality of charges,
- a first one of the detonators associated with a first one of said plurality of perforators detonating solely in response to said current of said first polarity, the charges associated with said first one of said plurality of perforators detonating in response to a detonation of said first one of the detonators,
- a second one of the detonators associated with a second one of said plurality of perforators detonating solely in response to said current of said second polarity, the charges associated with said second one of said plurality of perforators detonating in response to a detonation of said second one of the detonators,
- said first one of the detonators and said second one of the detonators each including,
- a first conductor adapted for conducting a current,
- a second conductor adapted for receiving said current,
- a foil interconnected between the first conductor and the second conductor, said foil including a bridge means for vaporizing when said current flows therethrough,
- a first layer deposited over said foil, and
- a spacer layer deposited over said first layer and disposed between said first layer and an explosive, said spacer layer including a hole disposed directly above said bridge means,
- said first layer expanding to form a bubble when said bridge means vaporizes, said bubble impacting and detonating said explosive during the expanding of said first layer, the detonator detonating when said bubble impacts and detonates said explosive; and first switch means connecting to said first one of the detonators for switching from a first position to a second position in response to detonation of said first one of the detonators, said second one of the detonators receiving said current of said first polarity when said first switch means switches to said second position, said second one of the detonators not detonating in response to said current of said first polarity.

9. The system of claim 8, wherein said hole in said spacer layer guides and forms said bubble into a predetermined shape and size during the expanding of said first layer, the shaped and sized bubble impacting and detonating said explosive.

10. The system of claim 8, further comprising:

sensor means connecting to said current carrying conductor for sensing said current of said first polarity and said current of said second polarity in said conductor, said sensor means including, ferrite core means, and coil means wrapped around said ferrite core means for receiving said current from said current carrying conductor and flowing said current therethrough, said core means including an output terminal, said output terminal generating an output signal representative of said current flowing in said current carrying conductor.

11. A detonator including an explosive, comprising:

a first conductor means for conducting a current;

a second conductor means for receiving said current;

bridge means interconnected between said first and second conductor means for vaporizing in response to said current;

disc means having a portion disposed adjacent said bridge means, the portion of said disc means being shared off in response to vaporization of said bridge means;

a barrel having a hole disposed adjacent said portion of said disc means, the hole receiving said portion of said disc means when said portion is sheared off from said disc means, said portion of said disc means flying through said hole in said barrel and adapted to impact said explosive; and barrier means adapted to be disposed within said hole in said barrel for receiving said portion of said disc means during the flight of said portion of said disc means through said hole in said barrel and preventing said portion of said disc means from impacting said explosive, said barrier means including a body and an elongated member connected to said body, said member having a surface and being adapted to be disposed within said hole in said barrel, said portion of said disc means impacting said surface of said member when said member is disposed within said hole in said barrel thereby preventing said portion of said disc means from impacting said explosive.

12. A detonator for detonating an explosive, comprising:

a first conductor adapted for conducting a current;

a second conductor adapted for receiving said current;

a foil interconnected between the first conductor and the second conductor, said foil including a bridge means for vaporizing when said current flows therethrough;

a first layer deposited over said foil; and a spacer layer deposited over said first layer and disposed between said first layer and said explosive, said spacer layer including a hole disposed directly above said bridge means;

said first layer expanding to form a bubble when said bridge means vaporizes, said bubble impacting and detonating said explosive during the expanding of said first layer.

13. The detonator of claim 12, wherein said hole in said spacer layer guides and forms said bubble into a predetermined shape and size during the expanding of said first layer, the shaped and sized bubble impacting and detonating said explosive.

14. A system for detonating an explosive, comprising:

a first conductor adapted for conducting a current;

a second conductor adapted for receiving said current;

a foil interconnected between the first conductor and the second conductor, said foil including a bridge means for vaporizing when said current flows therethrough;

a first layer deposited over said foil; and a spacer layer deposited over said first layer and disposed between said first layer and said explosive, said spacer layer including a hole disposed directly above said bridge means;

said first layer expanding to form a bubble when said bridge means vaporizes, said bubble impacting and detonating said explosive during the expanding of said first layer.

15. The system of claim 14, wherein said hole in said spacer layer guides and forms said bubble into a predetermined shape and size during the expanding of said first layer, the shaped and sized bubble impacting and detonating said explosive.

16. A system for detonating an explosive, comprising:

a first conductor adapted for conducting a current;

a second conductor adapted for receiving said current;

a ceramic layer;

a foil disposed over said ceramic layer and interconnecting said first conductor to said second conductor, said foil including a bridge means for vaporizing when said current flows therethrough;

a first layer deposited over said foil; and a spacer layer deposited over said first layer and disposed between said first layer and said explosive, said spacer layer including a hole disposed directly above said bridge means, said first layer expanding to form a bubble when said bridge means vaporizes, said bubble impacting and detonating said explosive during the expansion of said first layer.

17. The system of claim 16, wherein said hole in said spacer layer guides and forms said bubble into a predetermined shape and size during the expanding of said first layer, the shaped and sized bubble impacting and detonating said explosive.

18. A method of detonating an explosive, comprising the steps of:

flowing a current through a foil thereby vaporizing a portion of said foil;

expanding a portion of a layer of material disposed adjacent said portion of said foil to thereby form a bubble in said portion of said layer of material in response to the vaporization of said portion of said foil; and forcing said bubble through a hole in a further layer of material disposed adjacent said layer of material thereby shaping and sizing said bubble during the expansion of said portion of said layer of material, the shaped and sized bubble impacting said explosive thereby detonating said explosive.

19. The method of claim 18, wherein said hole in said further layer of material is disposed directly above said portion of said layer of material.

20. A method of preventing a detonator from detonating, said detonator including a plate which is adapted to fly across a space disposed between said plate and an explosive, comprising the step of:

inserting a barrier into said space, said barrier including a body and an elongated member connected to said body, said member having a surface and adapted to be inserted into said space, said plate impacting said surface of said member when said member is inserted into said space and said plate flies across said space, the flying plate failing to impact said explosive when said plate impacts said surface of said member, the detonator failing to detonate when the flying plate fails to impact said explosive.

21. A system for preventing the detonation of an explosive, comprising:

a disc spaced from said explosive thereby defining a space between said disc and said explosive, a portion of said disc defining a plate, said plate being adapted to fly across said space to impact said explosive; and a barrier adapted to be disposed within said space between said plate and said explosive, said barrier including a body and an elongated member connected to said body, said member having a surface and being adapted to be disposed within said space, said plate impacting the surface of said member when said member is disposed within said space and said plate flies across said space.

22. A detonator including an explosive, comprising:

a disc spaced from said explosive thereby defining a space between said disc and said explosive, a portion of said disc defining a plate, said plate being adapted to fly across said space to impact said explosive; and a barrier adapted to be disposed within said space between said plate and said explosive, said barrier including a body and an elongated member connected to said body, said member having a surface and being adapted to be disposed within said space, said plate impacting said explosive when said member is not disposed within said space and said plate flies across said space, said plate impacting said surface of said member when said member is disposed within said space and said plate flies across said space.

* * * * *